US006646960B1

(12) United States Patent
Nagata

(10) Patent No.: US 6,646,960 B1
(45) Date of Patent: Nov. 11, 2003

(54) ELECTRONIC TIMEPIECE

(75) Inventor: Yoichi Nagata, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/807,429

(22) PCT Filed: Oct. 22, 1999

(86) PCT No.: PCT/JP99/05865

§ 371 (c)(1),
(2), (4) Date: Apr. 20, 2001

(87) PCT Pub. No.: WO00/23853

PCT Pub. Date: Apr. 27, 2000

(30) Foreign Application Priority Data

Oct. 22, 1998 (JP) ..... 10-300609

(51) Int. Cl.[7] ..... G04C 3/00
(52) U.S. Cl. ..... 368/204; 368/66; 320/101
(58) Field of Search ..... 368/203, 204, 368/205, 66; 136/242; 320/101

(56) References Cited

U.S. PATENT DOCUMENTS

| | | | | | |
|---|---|---|---|---|---|
| 4,163,193 | A | * | 7/1979 | Kamiya | 368/204 |
| RE35,043 | E | * | 9/1995 | Takeda | 368/205 |
| 5,581,519 | A | * | 12/1996 | Hara et al. | 368/204 |
| 5,835,457 | A | * | 11/1998 | Nakajima | 368/204 |
| 5,889,734 | A | * | 3/1999 | Sato | 368/204 |
| 5,943,301 | A | * | 8/1999 | Igarashi | 368/204 |
| 5,978,318 | A | * | 11/1999 | Kawaguchi et al. | 368/204 |
| 6,061,304 | A | * | 5/2000 | Nagata et al. | 368/204 |
| 6,069,846 | A | * | 5/2000 | Nagata | 368/204 |
| 6,194,876 | B1 | * | 2/2001 | Nagata | 368/204 |
| 6,232,543 | B1 | * | 5/2001 | Nagata | 136/242 |
| 6,278,663 | B1 | * | 8/2001 | Okeya et al. | 368/204 |
| 6,462,967 | B1 | * | 10/2002 | Fujisawa et al. | 368/204 |

FOREIGN PATENT DOCUMENTS

| | | |
|---|---|---|
| JP | 53-52160 | 5/1978 |
| JP | 62-71886 | 4/1987 |
| JP | 4-81754 | 12/1992 |
| JP | 6-80195 | 11/1994 |
| JP | 8-36070 | 2/1996 |
| JP | 9-15352 | 1/1997 |
| WO | WO98/35272 | 8/1998 |

* cited by examiner

*Primary Examiner*—David Martin
*Assistant Examiner*—Jeanne-Marguerite Goodwin
(74) *Attorney, Agent, or Firm*—Armstrong, Westerman & Hattori, LLP

(57) ABSTRACT

An electronic timepiece comprises power generation means for generating electricity by using external energy, storage means for storing electric energy received from the power generation means, time-indicating means powered by electric energy supplied from the power generation means or the storage means for indicating time, a switch circuit including a plurality of switching devices and adapted to transfer or intercept electric energy between the power generation means and the storage means and between the power generation means and the time-indicating means, voltage measuring means for measuring voltage across the time-indicating means, and control means that selects one of predetermined power ratios based on the results of measurement by the voltage measuring means and controls the switch circuit according to the selected ratio when the power generation means charges the storage means and the time-indicating means.

12 Claims, 7 Drawing Sheets

ELECTRONIC TIMEPIECE

TECHNICAL FIELD

The present invention relates to an electronic timepiece (watch and clock) incorporating power generation means (generator) for generating electricity by utilizing external available energy, and particularly, to an electronic timepiece having a function of storing the electric energy generated by the power generation means, and driving time-indicating means for executing a time display operation by the agency of the electric energy stored.

BACKGROUND TECHNOLOGY

There has lately become commercially practical an electronic timepiece provided with built-in power generation means for converting external energy such as optical energy, thermal energy, mechanical energy, and so forth into electric energy, and utilizing the electric energy as driving energy for executing a time display operation.

Among such electronic timepieces provided with the built-in power generation means, there are included a solar cell timepiece using a solar cell, a mechanical electric power generation timepiece converting mechanical energy generated by a rotary weight into electric energy and utilizing the same, and a thermoelectric power generation timepiece generating electricity by utilizing the difference in temperature between the opposite ends of each of thermocouples connected in series.

It is essential for these electronic timepieces provided with the built-in power generation means to have built-in means for storing generated electric energy therein while the external energy is available so that the timepieces are driven continuously and stably all the time even when the external energy is no longer available. Such an electronic timepiece has been disclosed in, for example, JP, 4-81754, B.

FIG. 7 shows an example of a conventional electronic timepiece provided with a built-in power generation means, including electric energy storage means.

With the timepiece, power generation means 10 is a solar cell, and the positive terminal thereof is grounded, forming a closed circuit with a first diode 43 and time-indicating means 21. The time-indicating means 21 is comprised of a time-indicating block 22 for executing time display by the agency of electric energy, and a capacitor 23 having capacitance of 22 $\mu$F, which are connected in parallel.

Further, the power generation means 10 forms another closed circuit with a second diode 44, a first switching device 41, and storage means 30.

A second switching device 42 interconnects the negative terminal of the capacitor 23 and the negative terminal of the storage means 30 such that the capacitor 23 and the storage means 30 can be coupled in parallel.

A switch circuit 40 for performing transfer or interruption of electric energy among the power generation means 10, the storage means 30, and the time-indicating means 21 is comprised of the first switching device 41, the second switching device 42, the first diode 43, and the second diode 44.

Further, a first voltage comparator 16 compares a terminal voltage of the capacitor 23 with a first threshold value, and a second voltage comparator 17 compares the terminal voltage of the capacitor 23 with a second threshold value. The comparison result of the first voltage comparator 16 and that of the second voltage comparator 17 are caused to be inputted to a time-indicating block 22, thereby controlling the first switching device 41 by a first switching signal S21 outputted by a control circuit within the time-indicating block 22.

In this case, the first threshold value is −2.0 V, and the second threshold value is −1.5 V.

Further, a third voltage comparator 18 compares a terminal voltage of the storage means 30 with a third threshold value, and the comparison result thereof is caused to be inputted to the time-indicating block 22, thereby controlling the second switching device 42 by a second switching signal S22 outputted by the control circuit within the time-indicating block 22. In this case, the third threshold value is −2.0 V as well.

The first, second, and third voltage comparators 16, 17, 18 perform a comparison operation intermittently in a cycle of one second, respectively.

In a circuit diagram shown in FIG. 7, upon the start of generation of electric energy by the power generation means 10, the capacitor 23 of small capacitance is first charged with the electric energy, and the time-indicating means 21 starts a time-indicating operation by the agency of the electric energy stored in the capacitor 23. At this point in time, the second switching device 42 is open.

Upon a voltage between the terminals of the capacitor 23 reaching 2.0 V or higher, and an input voltage to the first voltage comparator 16 becoming −2.0 V or lower since the positive terminal thereof is grounded, the first voltage comparator 16 detects such a condition, and depending on the result of detection, the time-indicating block 22 closes the first switching device 41, thereby causing the storage means 30 to be charged.

Conversely, upon a voltage between the terminals of the capacitor 23 becoming lower than 1.5 V, and an input voltage to the second voltage comparator 17 becoming higher than −1.5 V, the second voltage comparator 17 detects such a condition, and depending on the result of detection, the time-indicating block 22 opens the first switching device 41, thereby causing the capacitor 23 side of the time-indicating means 21 to be charged.

Further, upon a voltage between the terminals of the storage means 30 exceeding 2.0 V as the charging of the storage means 30 proceeds, and an input voltage to the third voltage comparator 18 becoming −2.0 V or lower, the third voltage comparator 18 detects such a condition, and depending on the result of detection, the time-indicating block 22 closes the second switching device 42, thereby causing both the storage means 30 and the capacitor 23 to be charged.

However, the electric energy generated by the power generation means 10 undergoes variation depending on the external environment. For example, in the case of the solar cell, variation occurs mainly in quantity of electric current that can be outputted, and in the case of a thermoelectric power generation device, a generated voltage undergoes variation depending on the difference in temperature impressed from outside.

That is, depending on the external environment, the electric energy generated by the power generation means 10 undergoes an abrupt increase at times, thereby causing a voltage between the terminals of the capacitor 23 inside the time-indicating means 21 to undergo an abrupt rise.

As a result, there have occurred cases where an underload driving operation of the time-indicating block 22 connected with the capacitor 23 in parallel becomes unstable, so that time display can not be executed properly.

It is possible to solve this problem by various means such as by increasing capacitance of the capacitor 23, by causing the respective voltage comparators to perform a comparison operation in a shorter cycle, and so forth, however, a large capacitance capacitor results in an increase of the size thereof, so that such a capacitor can not be incorporated in a small-sized electronic timepiece such as a wrist watch.

Further, since an amplifier such as the first, second, and third voltage comparators 16, 17, 18 has relatively large energy consumption, there has also arisen a problem that frequent activation of the voltage comparators deteriorates energy efficiency.

The invention has been developed to solve the above-described problems encountered by the conventional electronic timepiece provided with the built-in power generation means, and it is therefore an object of the invention to enable control of the under-load driving operation for time display and the charging of the storage means to be efficiently executed even if variation occurs to a terminal voltage of the power generation means or to that of the storage means.

DISCLOSURE OF THE INVENTION

To this end, an electronic timepiece according to the invention comprises: power generation means for generating electricity from external energy; storage means for storing the electric energy generated by the power generation means; time-indicating means for executing time display operation by use of the electric energy supplied from the power generation means or the storage means; a switching circuit comprising at least a plurality of switching devices, for executing transfer or interruption of the electric energy among the power generation means, the storage means, and the time-indicating means; voltage-measuring means for measuring a terminal voltage of the time-indicating means, being capable of deciding in which range the voltage is included among at least three levels of voltage ranges; and control means for controlling the switching circuit by determining a ratio of electric energy to be distributed between the storage means and the time-indicating means in a set period during charging of the storage means and the time-indicating means by the power generation means at any of at least three different ratios predetermined so that the ratios correspond to the voltage ranges one-to-one, according to results of measurement by the voltage measuring means.

The control means can be constituted so as to control the switching circuit by determining a ratio of supply time of charge current from the power generation means to the storage means to supply time of charge current from the power generation means to the time-indicating means in the set period during charging of the storage means and the time-indicating means by the power generation means at any of at least three different ratios predetermined so that the ratios correspond to the voltage ranges one-to-one, according to the voltage range decided by the voltage measuring means.

Or the control means may be constituted so as to control the switching circuit by determining a ratio of impedance of a charge current supply circuit from the power generation means to the storage means to impedance of a charge current supply circuit from the power generation means to the time-indicating means during charging of the storage means and the time-indicating means by the power generation means at any of at least three predetermined different ratios according to the voltage range decided by the voltage measuring means.

Further, the electronic timepiece according to the invention may comprise: power generation means for generating electricity from external energy; voltage-up means (booster means) for boosting a voltage generated by the power generation means; storage means for storing electric energy boosted by the voltage-up means; time-indicating means for executing time display operation by use of the electric energy supplied from the voltage-up means or the storage means; a switching circuit comprising at least a plurality of switching devices, for executing transfer or interruption of the electric energy among the voltage-up means, the storage means, and the time-indicating means; voltage-measuring means for measuring a terminal voltage of the time-indicating means, being capable of deciding in which range the voltage is included among at least three levels of voltage ranges; and control means for controlling the switching circuit by determining a ratio of electric energy to be distributed between the storage means and the time-indicating means in a set period during charging of the storage means and the time-indicating means by the power generation means via the voltage-up means at any of at least three different ratios predetermined so that the ratios correspond to the voltage ranges one-to-one, according to results of measurement by the voltage measuring means.

In such a case as described above, the control means can be constituted so as to control the switching circuit by determining a ratio of supply time of charge current from the voltage-up means to the storage means to supply time of charge current from the voltage-up means to the time-indicating means in the set period during charging of the storage means and the time-indicating means by the power generation means via the voltage-up means at any of at least three different ratios predetermined so that the ratios correspond to the voltage ranges one-to-one, according to the voltage range decided by the voltage measuring means.

Or the control means may be constituted so as to control the switching circuit by determining a ratio of impedance of a charge current supply circuit from the voltage-up means to the storage means to impedance of a charge current supply circuit from the voltage-up means to the time-indicating means during charging of the storage means and the time-indicating means by the power generation means at any of at least three predetermined different ratios according to the voltage range decided by the voltage measuring means.

Further, with either of the electronic timepieces as described above, the time-indicating means is preferably provided with electric energy amount control means for controlling an amount of electric energy consumed by the time-indicating means for executing time display so as to be within a predetermined range all the time according to the results of measurement by the voltage measuring means.

Furthermore, in the case of the time-indicating means comprising a stepping motor, the electric energy amount control means is preferably constituted so as to control an amount of electric energy consumed by the time-indicating means for executing time display so as to be within a predetermined range all the time by setting a pulse at which electric current is supplied to the stepping motor to any of a plurality of predetermined different shapes as selected according to the results of measurement by the voltage measuring means.

With any of the electronic timepieces as described above, the time-indicating means preferably comprises an auxiliary storage means for temporarily storing the electric energy.

With the electronic timepieces according to the invention constituted as described above, the electric energy generated by the power generation means can be distributed between the time-indicating means and the storage means at a suitable ratio of electric energy for charging the both. This enables efficiency of charging the storage means with the electric energy generated by the power generation means to be rendered better than before even if a cycle of the measurement is the same as before.

Further, even if an abrupt change occurs to the electric energy generated due to a change in the external environment, it is possible to prevent an abrupt change from occurring to a voltage between the terminals of the time-indicating means, so that time-indicating operation of the time-indicating means can be stabilized.

BEST MODE FOR CARRYING OUT THE INVENTION

Embodiments of an electronic timepiece according to the invention will be described in more detail hereinafter with reference to the accompanying drawings.

First Embodiment

Figure 1:
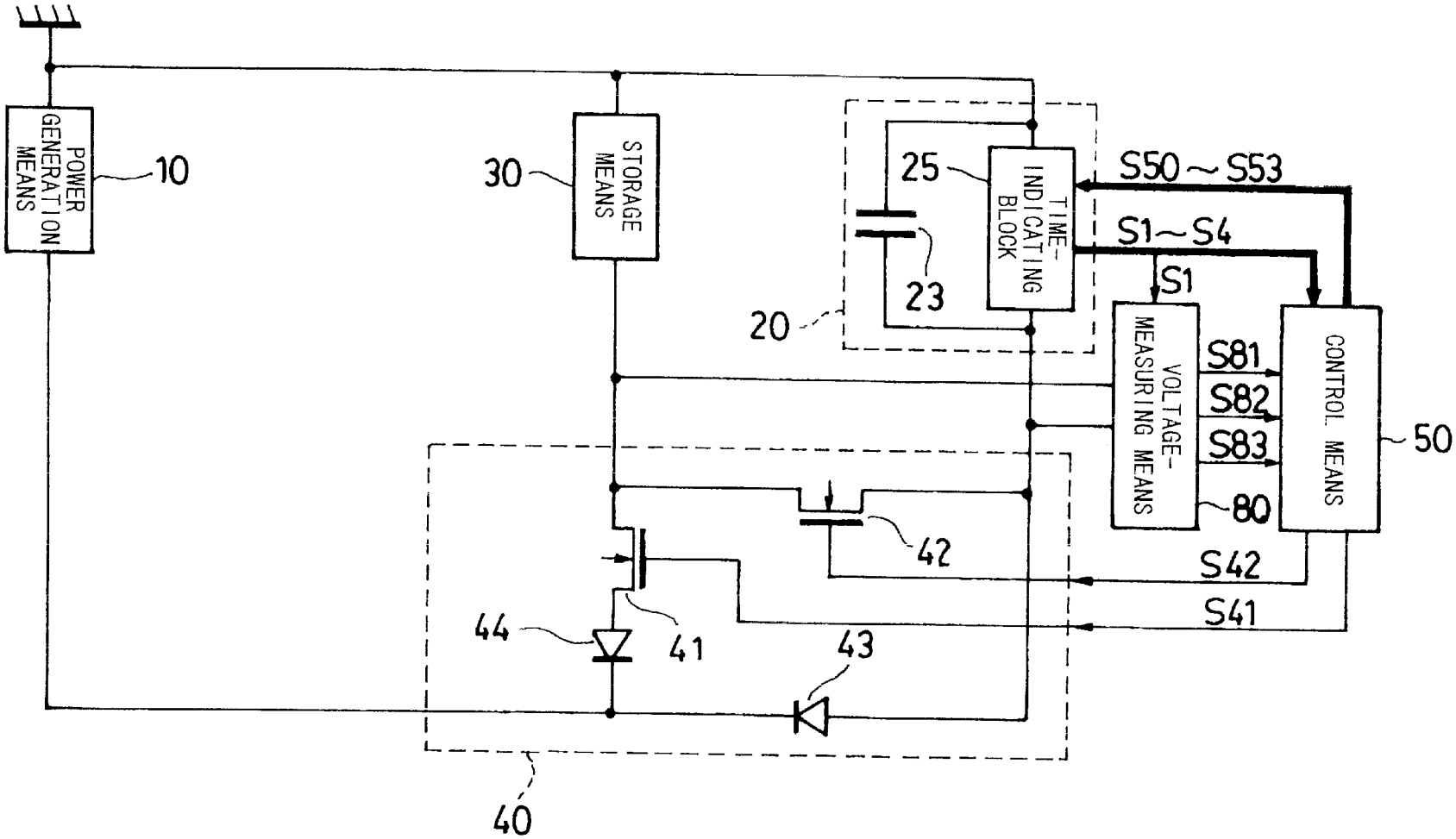
FIG. 1 is a block circuit diagram showing the constitution of a first embodiment of an electronic timepiece according to the invention.
Figure 2:
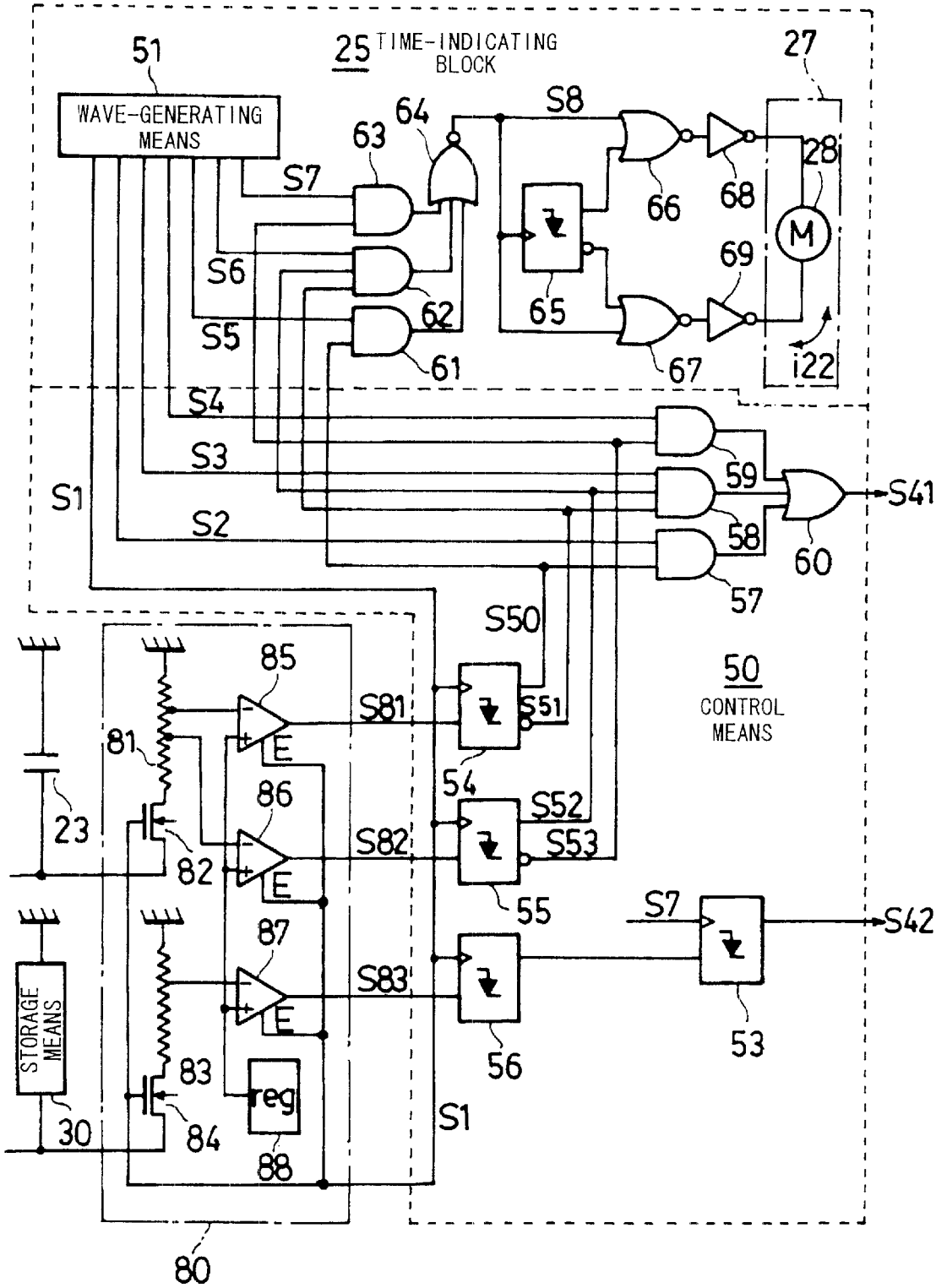
FIG. 2 is a circuit diagram showing a specific example of a time-indicating block, voltage-measuring means, and control means of the electronic timepiece shown in FIG. 1.
Figure 3:
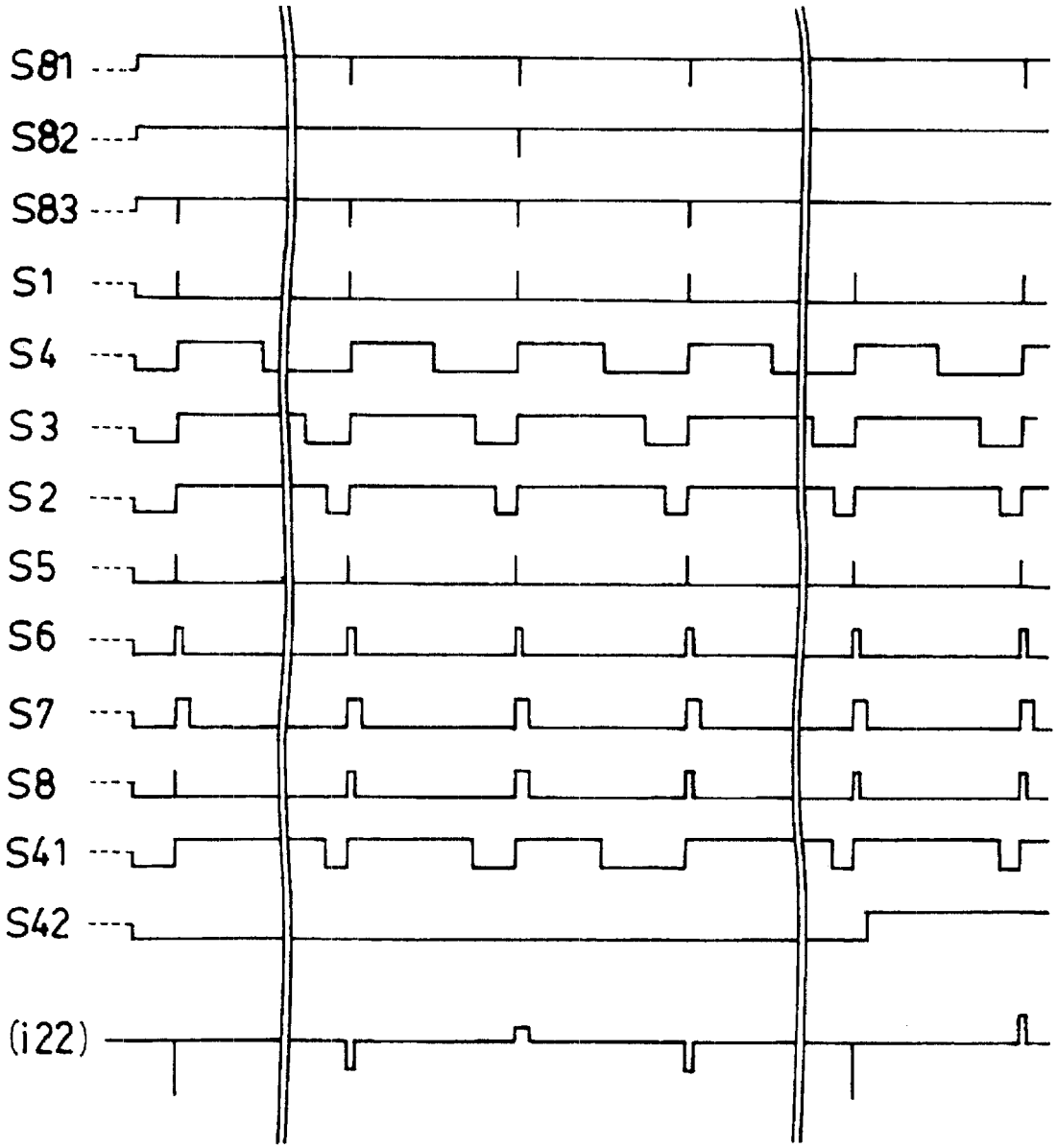
FIG. 3 is a waveform chart showing a waveform in respective parts of the electronic timepiece shown in FIGS. 1 and 2.

FIGS. 1 to 3

A first embodiment of an electronic timepiece according to the invention is described referring to FIGS. 1 to 3.

Figure 7:
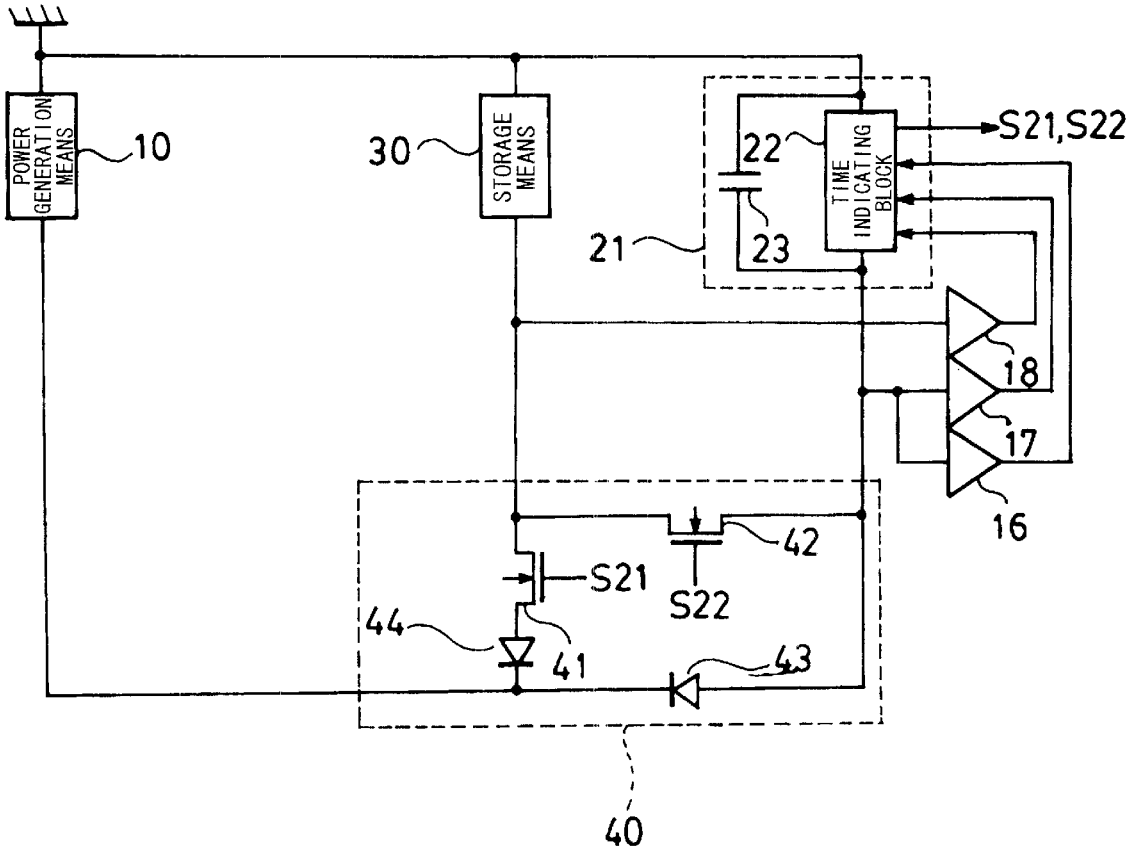
FIG. 7 PRIOR ART
FIG. 7 is a block circuit diagram showing an example of the constitution of a conventional electronic timepiece provided with built-in power generation means.

FIG. 1 is a block circuit diagram showing the constitution of the electronic timepiece, and in the figure, parts corresponding to those of the conventional example shown in FIG. 7 are denoted by like reference numerals. FIG. 2 is a circuit diagram showing a specific example of a time-indicating block 25, voltage measuring means 80, and control means 50, shown in FIG. 1, and FIG. 3 is a waveform chart showing a signal waveform of respective parts of the electronic timepiece.

With this embodiment, it is assumed that use is made of a thermoelectric power generator (thermoelectric device) for converting energy caused by the difference in temperature existing outside of the electronic timepiece to electric energy as power generation means 10 incorporated in the electronic timepiece. However, the scope of the invention is not limited thereto, and a solar cell, a mechanical electric power generator, or so forth may be used instead.

Further, although not shown in the figure, the electronic timepiece according to this embodiment has a construction wherein the thermoelectric device comprised of a plurality of thermocouples connected in series, serving as the power generation means 10, is disposed so as to cause a hot junction side thereof to be in contact with a case back, and a cold junction side thereof to be in contact with a metal case thermally insulated from the case back cover so that the electronic timepiece is driven by generated electric energy obtained by the difference in temperature occurring between the metal case and the case back when the electronic timepiece is being carried by a user.

In this case, the power generation means 10 is assumed to be able to develop a thermoelectromotive force (voltage) of about 2.0 V for every 1° C. of the difference in temperature occurring between the hot junction side and the cold junction side.

As with the conventional example shown in FIG. 7, with the timepiece according to this embodiment as well, the power generation means 10 has the positive terminal that is grounded, forming a closed circuit with a first diode 43 and time-indicating means 20.

The time-indicating means 20 is comprised of a time-indicating block 25 for executing time display by the agency of electric energy, and a capacitor 23 having small capacitance of 22 $\mu$F, which are connected in parallel.

Further, the power generation means 10 forms another closed circuit with a second diode 44, a first switching device 41, and storage means 30.

A second switching device 42 interconnects the negative terminal of the capacitor 23 and the negative terminal of the storage means 30 such that the capacitor 23 and the storage means 30 can be coupled in parallel.

A switching circuit 40 for executing transfer or interruption of electric energy among the power generation means 10, the storage means 30, and the time-indicating means 20 is comprised of the first and second switching devices 41, 42 and the first and second diodes 43, 44.

The first diode 43 and the second diode 44, serving as switching devices for preventing backward flow of electric energy to the power generation means 10, are connected to the power generation means 10.

That is, the cathode of both the first diode 43 and the second diode 44 is connected to the negative terminal of the power generation means 10. The anode of the first diode 43 is connected to the negative terminal of the time-indicating means 20 while the anode of the second diode 44 is connected to the negative terminal of the storage means 30 via the first switching device 41. Accordingly, the drain terminal of the first switching device 41 is connected to the negative terminal of the storage means 30, and the source terminal of the first switching device 41 is connected to the anode of the second diode 44.

The storage means 30 is, for example, a lithium ion secondary cell, and is provided in order to store electric energy generated by the power generation means 10 so as to enable the time-indicating means 20 to be operational even when no power is being generated by the power generation means 10. The storage means 30 as well has the positive terminal that is grounded.

The second switching device 42 is provided for the purpose of connecting the storage means 30 and the time-indicating means 20 in parallel. That is, the drain terminal of the second switching device 42 is connected to the negative terminal of the time-indicating means 20, and the source terminal thereof is connected to the negative terminal of the storage means 30.

The first switching device 41 and the second switching device 42 are comprised of a MOS field effect transistor (FET), respectively, serving as a switching device for charging and discharging the storage means 30.

The time-indicating block 25 of the time-indicating means 20 comprises wave-generating means 51 for dividing the frequency of oscillating signals generated by a crystal oscillator used in common electronic timepieces and generating a driving waveform for a stepping motor 28, and a time display means 27 including the stepping motor 28, gears, the hands (the hour hand, the minute hand, the second hand) for displaying time, and so forth driven by the driving waveform generated by the wave-generating means 51 (refer to FIG. 2). The constitution of the time-indicating block 25 will be further described in detail later on.

As with common type electronic timepieces, a complementary field effect MOS (CMOS) integrated circuit is used for a control circuit part of the time-indicating block 25 although not shown in the figure.

Further, the electronic timepiece according to this embodiment of the invention is provided with the voltage measuring means 80 capable of determining whether a voltage between the terminals of the capacitor 23 is less than 1.2 V, in a range from 1.2 V to 1.6 V, or in excess of 1.6 V, and also capable of determining whether a voltage between the terminals of the storage means 30 is less than 1.5 V or not less than 1.5 V.

A voltage at the negative terminal of the capacitor 23, and a voltage at the negative terminal of the storage means 30 are inputted to the voltage measuring means 80, and an output therefrom, that is, a first measurement result signal S81 to a third measurement result signal S83 are inputted to the control means 50. The control means 50 receives signals S1 to S4 from the time-indicating block 25, and outputs a first switch signal S41 and a second switch signal S42, thereby controlling opening and closing of the first and second switching devices 41, 42. Also, the control means 50 cause output signals S50 to S53 to be inputted to the time-indicating block 25.

Now, referring to FIG. 2, the time-indicating block 25, the voltage measuring means 80, and the control means 50 are described in detail.

As shown in FIG. 2, the voltage measuring means 80 according to this embodiment is comprised of a first dividing resistor 81, a first divider switch 82, a first amplifier 85, a second amplifier 86, a second dividing resistor 83, a second divider switch 84, a third amplifier 87, and a constant voltage circuit 88.

Further, the control means 50 is comprised of a first latch 54, a second latch 55, a third latch 56, and a fourth latch 53, a first AND gate 57, a second AND gate 58, and a third AND gate 59, and an OR gate 60.

The time-indicating block 25 of the time-indicating means 20 is comprised of the wave-generating means 51, fourth to sixth AND gates 61, 62, 63, a first NOR gate 64, a toggle flip-flop 65, second and third NOR gates 66, 67, first and second drivers 68, 69, and the time display means 27.

The logic gates described above are of a dual input type unless specified otherwise.

The wave-generating means 51 is a part of the time-indicating block 25, for dividing the frequency of the oscillating signal generated by the crystal oscillator at least until the signal has an oscillating period of 2 seconds or more, and further, transforming a divided signal into a waveform necessary for driving the stepping motor 28 incorporated in the time display means 27 as with the case of the common type electronic timepieces.

Further, the time display means 27 is comprised of the stepping motor 28, reduction gears (not shown), the hands for time display, a dial, and so froth, and is a part of the time-indicating block 25, for transmitting rotation of the stepping motor 28 while reducing a rotation velocity thereof by the agency of the reduction gears to thereby rotate the hands for time display, thus executing time display.

Since the wave-generating means 51 and the time display means 27 are similar in constitution to those of the common type electronic timepieces, detailed description thereof is omitted.

The wave-generating means 51 outputs a measurement signal S1, first to third distribution signals S2, S3, S4, and first to third display signals S5, S6, S7.

The measurement signal S1 is in a waveform rising to the HIGH level in 60 $\mu$s, having a period of one second.

Further, the first to third distribution signals S2, S3. S4 are signals providing timing as a basis on which the electric energy generated by the power generation means 10 is distributed between the storage means 30 and the capacitor 23.

The first to third distribution signals S2, S3, S4 are all in a waveform having a period of one second, the first distribution signal S2 stays at the HIGH level for a duration of 875 milliseconds, the second distribution signal S3 stays at the HIGH level for a duration of 750 milliseconds, and the third distribution signal S4 stays at the HIGH level for a duration of 500 milliseconds.

The first to third display signals S5, S6, S7 are signals serving as a basis on which the stepping motor 28 incorporated in the time display means 27 is rotatably driven.

The first to third display signals S5, S6, S7 are all in a waveform having a period of one second, the first display signal S5 stays at the HIGH level for a duration of 3 milliseconds, the second display signal S6 stays at the HIGH level for a duration of 3.5 milliseconds, and the third display signal S7 stays at the HIGH level for a duration of 4 milliseconds.

In this case, timing of a waveform rise of the measurement signal S1, and that of the first to third distribution signals S2, S3, S4, respectively, are all synchronized with each other while timing of a waveform rise of the first to third display signals S5, S6, S7, respectively, is synchronized with timing of a waveform fall of the measurement signal S1.

Since generation of these waveforms can be implemented through a simple waveform synthesis, description of a method of generating the waveforms is omitted.

The first to third amplifiers 85, 86, 87 within the voltage measuring means 80 are constituted in such a way as to be able to compare an output voltage of the constant voltage circuit 88 with the other input voltage of the respective amplifiers.

The constant voltage circuit 88 is a regulator circuit in common use for obtaining a constant voltage from a power source at a varying voltage. In this case, the constant voltage circuit 88 is to output a constant voltage at −0.8 V, and is connected to the capacitor 23 such that energy for driving the constant voltage circuit 88 is supplied from the capacitor 23.

The capacitor 23 is a constituting element incorporated in the time-indicating means 20 described hereinbefore.

The first dividing resistor 81 is a high-prevision high-resistance element, and one end of the first dividing resistor 81 is connected to the drain terminal of the first divider switch 82 while the other end of the first dividing resistor 81 is rounded. The source terminal of the first divider switch 82 is connected to the negative terminal of the capacitor 23.

Similarly, one end of the second dividing resistor 83 which is a high-precision high-resistance element is connected to the drain terminal of the second divider switch 84 while the other end of the second dividing resistor 83 is grounded. Further, the source terminal of the second divider switch 84 is connected to the negative terminal of the storage means 30.

With this embodiment, both the first dividing resistor 81 and the second dividing resistor 83 have a resistance value of 600 KΩ, respectively.

The measurement signal S1 outputted from the time-indicating block 25 is inputted to the gate terminal of the first divider switch 82 as well as the second divider switch 84.

The first to third amplifiers 85, 86, 87 are comparators for voltage detection, and an output voltage of the constant voltage circuit 88 is inputted to a non-negative input terminal of the respective amplifiers.

Further, a midpoint of the first dividing resistor 81 is connected to a negative input terminal of the first amplifier 85. The midpoint is located at a point having a resistance value (300 KΩ) as seen from the ground side, equivalent to ¾ of the resistance value of the first dividing resistor 81.

Similarly, a point of the first dividing resistor 81, having a resistance value (400 KΩ from the ground side) equivalent to ⅔ of the resistance value of the first dividing resistor 81, is connected to a negative input terminal of the second amplifier 86.

Similarly further, a midpoint of the second dividing resistor 83 is connected to a negative input terminal of the third amplifier 87. Such a midpoint is located at a point having a resistance value (320 KΩ) as seen from the ground side, equivalent to 8/15 of the resistance value of the second dividing resistor 83.

With the constitution described above, upon turning the first divider switch 82 ON, flow of electric current occurs to the first dividing resistor 81, and ¾ of a negative terminal voltage of the capacitor 23 is inputted to the first amplifier 85, whereupon if such an input voltage falls below −0.8 V, that is, the output voltage of the constant voltage circuit 88, the first amplifier 85 outputs the HIGH level, otherwise outputting the LOW level.

That is, it is set such that the output of the first amplifier 85 turns to the HIGH level upon a voltage between the terminals of the capacitor 23 exceeding 1.6 V.

Similarly, it is constituted such that the second amplifier 86 outputs the HIGH level upon a voltage between the terminals of the capacitor 23 exceeding 1.2 V, and the third amplifier 87 outputs the HIGH level upon a voltage between the terminals of the storage means 30 exceeding 1.5V.

The first to third amplifiers 85, 86, 87 have an enable terminal, respectively, to which the measurement signal S1 is inputted. In other words, the first to third amplifiers 85, 86, 87 are operational only when the measurement signal S1 is at the HIGH level.

Further, when the first to third amplifiers 85, 86, 87 are not operational, that is, the enable terminal thereof is at the LOW level, an output of the respective amplifiers is to be raised to the HIGH level.

The output of the first amplifier 85, the second amplifier 86, and the third amplifier 87, respectively, is inputted to a data input of the first latch 54, the second latch 55, and the third latch 56, respectively.

The output of the first amplifier 85 as the first measurement result signal S81, the output of the second amplifier 86 as the second measurement result signal S82, and the output of the third amplifier 87 as the third measurement result signal S83 is data input of the first to third latches 54, 55, 56 of the control means 50 as described above, respectively.

The first to third latches 54, 55, 56 of the control means 50 are data latches whose the output is reset when the power source is turned ON. The respective latches are provided with a clock terminal, to which the measurement signal S1 is inputted, respectively, enabling retention and output of the signals with the data input at the falling edge of the waveform of the measurement signal S1.

The first AND gate 57 outputs an AND of an output signal S50 of the first latch 54 and the first distribution signal S2. The second AND gate 58 which is a triple-input AND gate outputs an AND of a negative output signal S51 of the first latch 54, an output signal S52 of the second latch 55, and the second distribution signal S3. Further, the third AND gate 59 outputs an AND of a negative output signal S53 of the second latch 55, and the third distribution signal S4.

Further, the OR gate 60 is connected to the first AND gate 57, the second AND gate 58, and the third AND gate 59 so as to be able to output an OR thereof. An output of the OR gate 60 is outputted as the first switch signal S41 to the switching circuit 40 in FIG. 1, thereby controlling opening and closing of the first switching device 41.

Meanwhile, the output of the third latch 56 is data input to the fourth latch 53. The fourth latch 53 as well is a data latch whose output is reset when the power source is turned ON. The third display signal S7 is inputted to the clock terminal of the fourth latch 53, enabling retention and output of the signal having data input at the falling edge of the waveform of the third display signal S7.

Then, the output of the fourth latch 53 is outputted as the second switching signal S42 to the switching circuit 40 in FIG. 1, thereby controlling opening and closing of the second switching device 42.

In the time-indicating block 25, the fourth AND gate 61 outputs an AND of the output signal S50 of the first latch 54 and the first display signal S5. The fifth AND gate 62 which is a triple-input AND gate outputs an AND of the negative output signal S51 of the first latch 54, the output signal S52 of the second latch 55, and the second display signal S6. Further, the sixth AND gate 63 outputs an AND of the negative output signal S53 of the second latch 55 and the third display signal S7.

In addition, the first NOR gate 64 outputs a negative signal of an OR of output of the fourth AND gate 61, the fifth AND gate 62, and the sixth AND gate 63. The output of the first NOR gate 64 is sent out as a select display signal S8.

The toggle flip-flop 65 is a toggle type flip-flop for inverting a signal to be retained and to be outputted every time an input signal rises, and the select display signal S8 is inputted thereto. For the sake of simplification in description, with the toggle flip-flop 65, retained data is assumed to be reset upon turning the power source ON in this case.

Further, the second NOR gate 66 outputs a negative signal of an OR of an output of the toggle flip-flop 65 and the select display signal S8.

Similarly, the third NOR gate 67 outputs a negative signal of an OR of a negative output of the toggle flip-flop 65 and the select display signal S8.

An output of the second NOR gate 66 is inputted to the first driver 68, and an output of the third NOR gate 67 is inputted to the second driver 69, so that the stepping motor 28 incorporated in the time display means 27 interconnects an output of the first driver 68 and an output of the second driver 69.

The first driver 68 and the second driver 69 are inverters with a very low impedance at the output terminal, respectively, and are constituted such that electric current i22 in an optional direction can be supplied to the stepping motor 28 connected to the respective output terminals by turning an input of either of the first driver 68 and the second driver 69 to the HIGH level while turning an input of the other to the LOW level.

With this embodiment, the voltage measuring means 80, the control means 50, and the time-indicating block 25 are constituted as described in the foregoing.

Now, operation of the electronic timepiece according to this embodiment is described with reference to FIGS. 1 and 2, and a waveform chart shown in FIG. 3.

First, the electronic timepiece is assumed to be in a condition wherein electric energy stored in the storage means 30 has been nearly depleted with a voltage between the terminals thereof at about 0.9V, and the time-indicating means 20 is out of operation.

The electronic timepiece according to this embodiment is constituted such that electronic timepiece in such a condition becomes operational when the voltage between the terminals of the storage means 30 reaches 1.0 V or higher, and such an actuation operation is first described hereinafter.

With the electronic timepiece at rest as described above, the power generation means 10 starts generation of electric energy in the forward direction, upon a voltage generated reaching about 1.0 V, the first diode 43 is turned ON, and the electric energy generated by the power generation means 10 is supplied to the time-indicating means 20.

When the time-indicating means 20 is thereby actuated, the wave-generating means 51 within the time-indicating block 25, shown in FIG. 2, starts outputting the measurement signal S1, the first to third distribution signals S2 to S4, and the first to third display signals S5 to S7, respectively.

Further, immediately after the actuation of the time-indicating means 20, the first latch 54, the second latch 55, the third latch 56, and the fourth latch 53 are initialized such that any of the latches outputs the LOW level.

As a result, the third AND gate 59 inside the control means 50 outputs the third distribution signal S4 as it is, while an output of the first AND gate 57 and the second AND gate 58 are kept at the LOW level. Accordingly, the first switch signal S41 which is the output of the OR gate 60 is the same as the third distribution signal S4, thereby controlling opening and closing of the first switching device 41.

Further, the second switch signal S42 remains at the LOW level, and the second switching device 42 controlled thereby is turned into an OFF condition.

At this point in time, a negative signal of the third display signal S7 appears in the select display signal S8 in the time-indicating block 25. However, as HIGH-level pulses of the measurement signal S1 appear therein immediately thereafter, the electronic timepiece proceeds in practice immediately to an operation taking place after the start of power generation as described hereinafter.

Upon appearance of the HIGH-level pulses in the measurement signal S1, both the first divider switch 82 and the second divider switch 84 of the voltage measuring means 80 are turned ON while the measurement signal S1 remains at the HIGH level, and subsequently, flow of electric current occurs to the first dividing resistor 81 and the second dividing resistor 83. As a result, a voltage equivalent to ¾ of a voltage between the terminals of the capacitor 23, and a voltage equivalent to ⅔ of a voltage between the terminals of the capacitor 23 are inputted to the first amplifier 85, and the second amplifier 86, respectively. Similarly, a voltage equivalent to 8/15 of a voltage between the terminals of the storage means 30 is inputted to the third amplifier 87.

At the fall timing of the measurement signal S1, the first latch 54, the second latch 55, and the third latch 56 capture an output of the first amplifier 85, the second amplifier 86, and the third amplifier 87, respectively.

Assuming that a storage voltage is low at 0.9 V but a generated voltage is sufficiently high at this point in time, and a voltage between the terminals of the capacitor 23 is in exceed of 1.6 V, both the first amplifier 85 and the second amplifier 86 output the HIGH level, and consequently, both the first latch 54 and the second latch 55 capture the HIGH level, and send out the same.

Hereupon, an output of any of the second AND gate 58, the third AND gate 59, the fifth AND gate 62, and the sixth AND gate 63 turns to the LOW level while either of inputs to the first AND gate 57 and the fourth AND gate 61 turns to the HIGH level. As a result, the OR gate 60 outputs the first distribution signal S2 as it is, and the first NOR gate 64 outputs a negative signal of the first display signal S5.

Accordingly, at the falling edge of the measurement signal S1, the first switch signal S41 becomes the same as the first distribution signal S2, and the select display signal S8 becomes the same as the negative signal of the first display signal S5.

Since the toggle flip-flop 65 flips over an output thereof every time a pulse at the LOW level is inputted, upon the select display signal S8 becoming the same as the negative signal of the first display signal S5, it follows that the second NOR gate 66 and the third NOR gate 67 alternately outputs a HIGH-level pulse of the first display signal S5.

This enables the first driver 68 and the second driver 69 to cause electric current changing the direction of flow every one second in synchronization with the HIGH-level pulse of the first display signal S5 to flow to the stepping motor 28. In FIGS. 2 and 3, the electric current flowing to the stepping motor 28 is denoted by reference numeral i22.

The time display means 27 thereby executes rotation of the hands for time display according to the first display signal S5 as with the case of the common type electronic timepiece.

A this point in time, the first switch signal S41 is in the same waveform as that of the first distribution signal S2, however, since any of the first to third distribution signals S2 to S4 is at the HIGH level in synchronization with the measurement signal S1, the first switch signal S41 is at the HIGH level, thereby turning the first switching device 41 into an ON condition.

Accordingly, the electric energy generated by the power generation means 10 is delivered to the storage means 30, thereby charging the storage means 30.

Further, since the first distribution signal S2 at the HIGH level turns to the LOW level after the elapse of 875 milliseconds from the rising edge of the measurement signal S1, the first switching device 41 is turned from an ON condition into an OFF condition, so that generated electric energy flowing from the power generation means 10 to the storage means 30 is rerouted so as to flow to the side of the time-indicating means 20, that is, to the capacitor 23.

At this point in time, the capacitor 23 is supplied with the generated electric energy for a short duration of 125 milliseconds (for every 1 second), however, since a voltage between the terminals of the capacitor 23 has already exceeded 1.6 V, there is no need for charging the capacitor 23 to a large extent, so that no problem will arise even if most of the generated electric energy is used for charging the storage means 30.

Further, although electric current is supplied to the stepping motor 28 incorporated in the time display means 27 for a duration of only 3 milliseconds, a voltage between the terminals of the capacitor 23 is sufficiently high, enabling sufficient driving electric current to be supplied to the stepping motor 28.

Subsequently, operation in the case where the generated electric energy of the power generation means 10 drops below the level described in the foregoing is described hereinafter.

Upon appearance of the HIGH-level pulse in the measurement signal S1, the first latch 54, the second latch 55, and the third latch 56 of the control means 50 capture the output of the first amplifier 85, the second amplifier 86, and the third amplifier 87 of the voltage-measuring means 80, respectively, at the fall timing of the measurement signal S1.

At this point in time, assuming that the storage voltage is low at 0.9 V but a voltage between the terminals of the capacitor 23 is in the order of 1.4 V due to a drop in the generated electric energy of the power generation means 10 and energy consumption caused by the time-indicating means 20, the first amplifier 85 outputs the LOW level, and the second amplifier 86 outputs the HIGH level. Accordingly, the first latch 54 captures the LOW level, and the second latch 55 captures the HIGH level, respectively, before outputting the same.

Hereupon, as the OR gate 60 outputs the second distribution signal S3 as it is, and the first NOR gate 64 outputs a negative signal of the second display signal S6, the first switch signal S41 becomes the same as the second distribution signal S3, and the select display signal S8 becomes the same as a negative signal of the second display signal S6 at the falling edge of the measurement signal S1.

At this point in time, a voltage between the terminals of the capacitor 23 is at around 1.4 V, lower than the previously described level, however, since electric current is supplied to the stepping motor 28 of the time-indicating block 25 for a duration of 3.5 milliseconds, longer than the previously-described duration of 3 milliseconds, it is possible to supply electric energy for driving the stepping motor 28 substantially equivalent in quantity to that in the previously described case.

Further, the first switch signal S41 having turned to the HIGH level at the rising edge of the measurement signal S1 will turn to the LOW level with the elapse of 750 milliseconds. It follows that the generated electric energy of the power generation means 10 will be delivered to the capacitor 23 for a duration of 250 milliseconds.

In this case as well, since the generated electric energy of the power generation means 10 will be less than that for the previously described case, charging time of the capacitor 23 is rendered longer than 125 milliseconds as for the previously described case, thereby enabling the time-indicating block 25 to continue a time-indicating operation.

Further, when the previously-described condition of power generation continues, and a voltage between the terminals of the capacitor 23 is lower than 1.2 V while a storage voltage is lower than 1.5 V, the time-indicating means 20 sets the charging time of the capacitor 23 to 500 milliseconds, and sets pulses for driving the stepping motor 28 at 4 milliseconds by going through the same steps as described above.

Since electric energy stored in the capacitor 23 at this point in time is lower than that in the previously described condition, the charging time of the capacitor 23 is rendered longer than 250 milliseconds as for the previously described case, thereby enabling energy necessary for continuance of the time-indicating operation of the time-indicating block 25 to be obtained from the power generation means 10.

Further, as for the stepping motor 28 of the time-indicating block 25, energy necessary for driving the stepping motor 28 can be supplied to the stepping motor 28 by setting time for supply of electric current thereto longer than 3.5 milliseconds as set for the previously described case.

Operation in a condition wherein the charging of the storage means 30 is sufficiently executed is described hereinafter.

In a condition wherein the charging of the storage means 30 proceeds, and a voltage between the terminals of the storage means 30 comes to exceed 1.5V, the output of the third amplifier 87 is the HIGH level when the third latch 56 of the control means 50 captures an output of the third amplifier 87 of the voltage measuring means 80, and consequently, the third latch 56 captures the output, and outputs at the HIGH level.

The output of the third latch 56 is inputted to the fourth latch 53, however, this does not cause the second switch signal S42 to undergo an immediate change. At the falling edge of the third display signal S7, the fourth latch 53 captures the output of the third latch 56, thereby causing the second switch signal S42 to undergo a change to the HIGH level.

That is, the second switch signal S42 turns to the HIGH level at least after the select display signal S8 is turned to the LOW level.

Hereupon, the second switching device 42 shown in FIG. 1 is turned ON, and the time-indicating means 20 and the storage means 30 are connected in parallel, so that electric energy generated by the power generation means 10 is supplied simultaneously to both the time-indicating means 20 and the storage means 30.

By this point in time, a voltage between the terminals of the storage means 30 reaches a level sufficient for operation of the time-indicating means 20, enabling the time-indicating means 20 to continue a stable time-indicating operation thereafter.

With this embodiment, as a length of time for charging the capacitor 23 is set so as to be half (500 milliseconds) of one second, that is, a measuring cycle of the voltage measuring means 80, or less at most, variation in voltage between the terminals of the capacitor 23 can be rendered more moderate than before even if the power generation means 10 starts generation of power abruptly. As a result, the time-indicating block 25 can be stably operated.

Furthermore, with this embodiment, since it is arranged such that a driving condition of the stepping motor 28 incorporated in the time-indicating block 25 is suitably set according to a voltage between the terminals of the capacitor 23, even if a voltage between the terminals of the capacitor 23 rises slowly, electric energy within a predetermined range can be supplied to the stepping motor 28 according to such a condition, so that it is possible to drive the stepping motor 28 efficiently.

Thus, with the first embodiment of the electronic timepiece according to the invention, the control means 50 controls the switching circuit 40 by determining a ratio of electric energy to be distributed between the storage means 30 and the time-indicating means 20 in a set period (1 second in this example) during charging of the storage means 30 and the time-indicating means 20 by the power generation means 10 at any of at least three different ratios predetermined so that the ratios correspond to the voltage ranges one-to-one, according to results of measurement, that is, as described above, results of decision in which range the voltage is included among at least three levels of voltage ranges, by the voltage measuring means 80 for measuring a terminal voltage of the time-indicating means 20 (a voltage between the terminals of the capacitor 23).

The distribution ratio of the electric energy is varied by selecting any of the first, second, and third distribution signals S2, S3, S4 shown in FIG. 3, having a different duty, respectively, as a first switch signal, and controlling the opening and closing of the first switching device 41 by the signal, thereby selecting a ratio of supply time of charge current from the power generation means 10 to the storage means 30 to that of charge current from the power generation means 10 to the time-indicating means 20.

In addition, with this embodiment, an amount of electric energy consumed by the time-indicating means 20 for executing time display is controlled by electric energy amount control means installed in the time-indicating block 25 so as to be within a predetermined range all the time on the basis of the results of measurement by the voltage measuring means 80.

With this embodiment, the voltage measuring means 80 are put into commission only once for every second for implementation of a charging control operation.

With the conventional electronic timepiece as shown in FIG. 7, voltage measurement needs to be performed at least 4 times for every second for implementation of a similar charging control operation, and accordingly, with this embodiment, it is also possible to reduce measurement energy necessary for voltage measurement.

Further, with this embodiment, the thermoelectric power generator is employed for the power generation means 10, however, other generators may be employed. For example, a solar cell and the like may be employed for the power generation means 10 without any problem.

Even in the case of employing the thermoelectric power generator for the power generation means 10, use may be made of one having an electromotive force of about 1.0 V for every 1° C. of the difference in temperature by reducing the number of the thermocouples composing the thermoelectric generator, utilizing a voltage-up circuit whereby a generated voltage is boosted by a reduced portion thereof.

Second Embodiment

FIG. 4

Subsequently, a second embodiment of an electronic timepiece according to the invention, provided with power generation means and voltage-up means, is described hereinafter with reference to FIG. 4.

Figure 4:
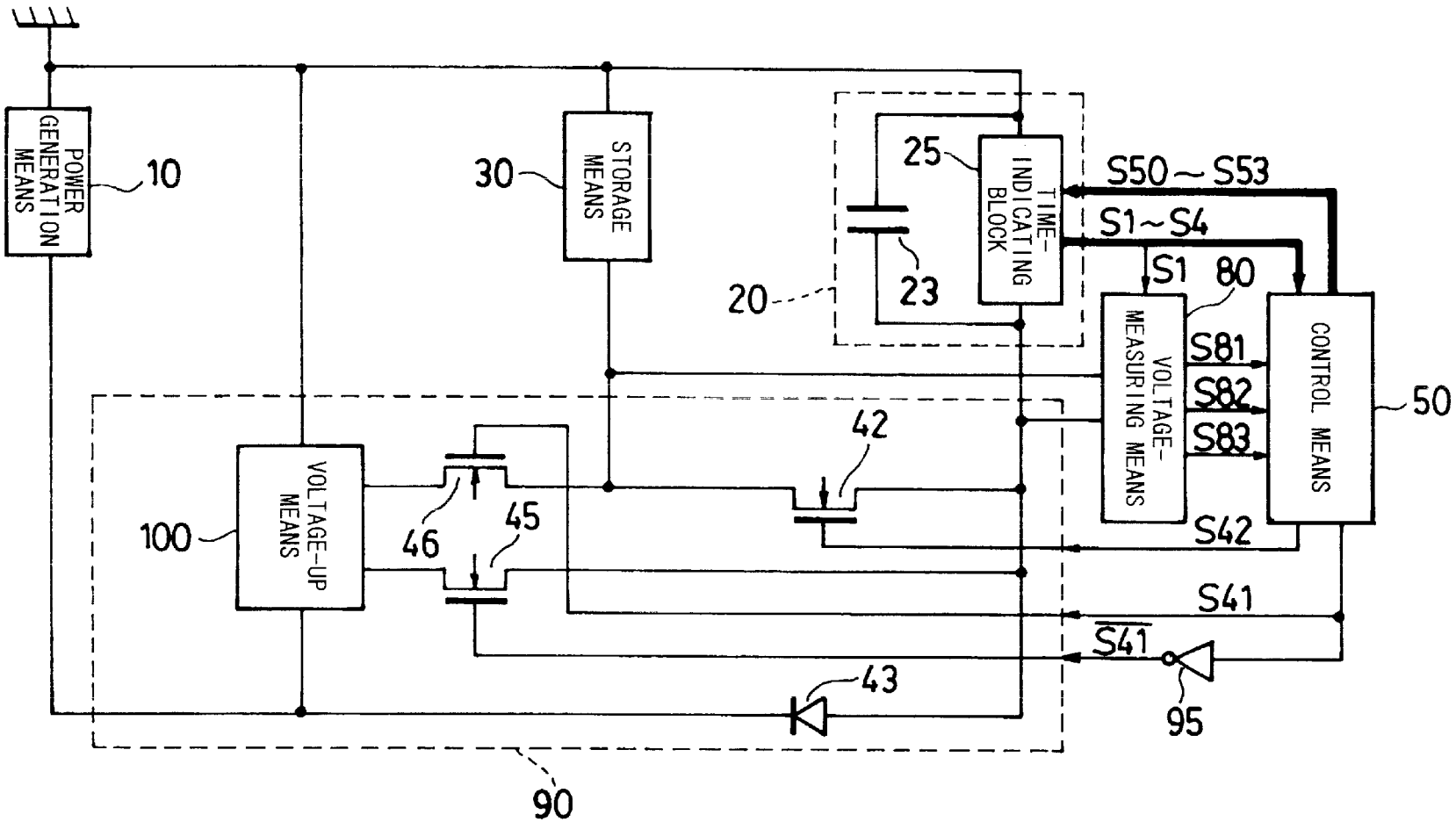
FIG. 4 is a block circuit diagram showing the constitution of a second embodiment of an electronic timepiece according to the invention.

FIG. 4 is a block circuit diagram showing the constitution of the electronic timepiece, and in the figure, parts corresponding to those in FIG. 1 are denoted by like reference numerals, description thereof is omitted.

The electronic timepiece according to this embodiment differs from the electronic timepiece shown in FIG. 1 in that a voltage-up means 100 is installed and the constitution of a switching circuit 90 is somewhat different from that of the switching circuit 40 shown in FIG. 1.

More specifically, with the electronic timepiece shown in FIG. 4, the voltage-up means 100 which is a voltage-up circuit capable of boosting a voltage between the terminals of the power generation means 10 is connected to the power generation means 10 in parallel. Further, a third switching device 45 interconnects the negative terminal of time-indicating means 20 and an output terminal of the voltage-up means 100 while a fourth switching device 46 interconnects the negative terminal of storage means 30 and the other output terminal of the voltage-up means 100 such that an output of the voltage-up means 100 can be apportioned between the time-indicating means 20 and the storage means 30.

Further, this embodiment is constituted such that the third switching device 45 is controlled by a negative signal/S41, that is, the inverse of a first switch signal S41 outputted by an inverter 95, and the fourth switching device 46 is controlled by the first switch signal S41, so that the same operation and effect as those for the first embodiment described in the foregoing can be obtained even in the case of utilizing the voltage-up means.

In case that energy greater than normally required is needed for driving the stepping motor 28 shown in FIG. 2 or other loads, a ratio of time for delivering electric energy generated by the power generation means 10 to the time-indicating means 20 to the same for delivering electric energy generated by the power generation means 10 to the storage means 30 may be set at a value differing from that for the previously described case.

Third Embodiment

Figure 5:
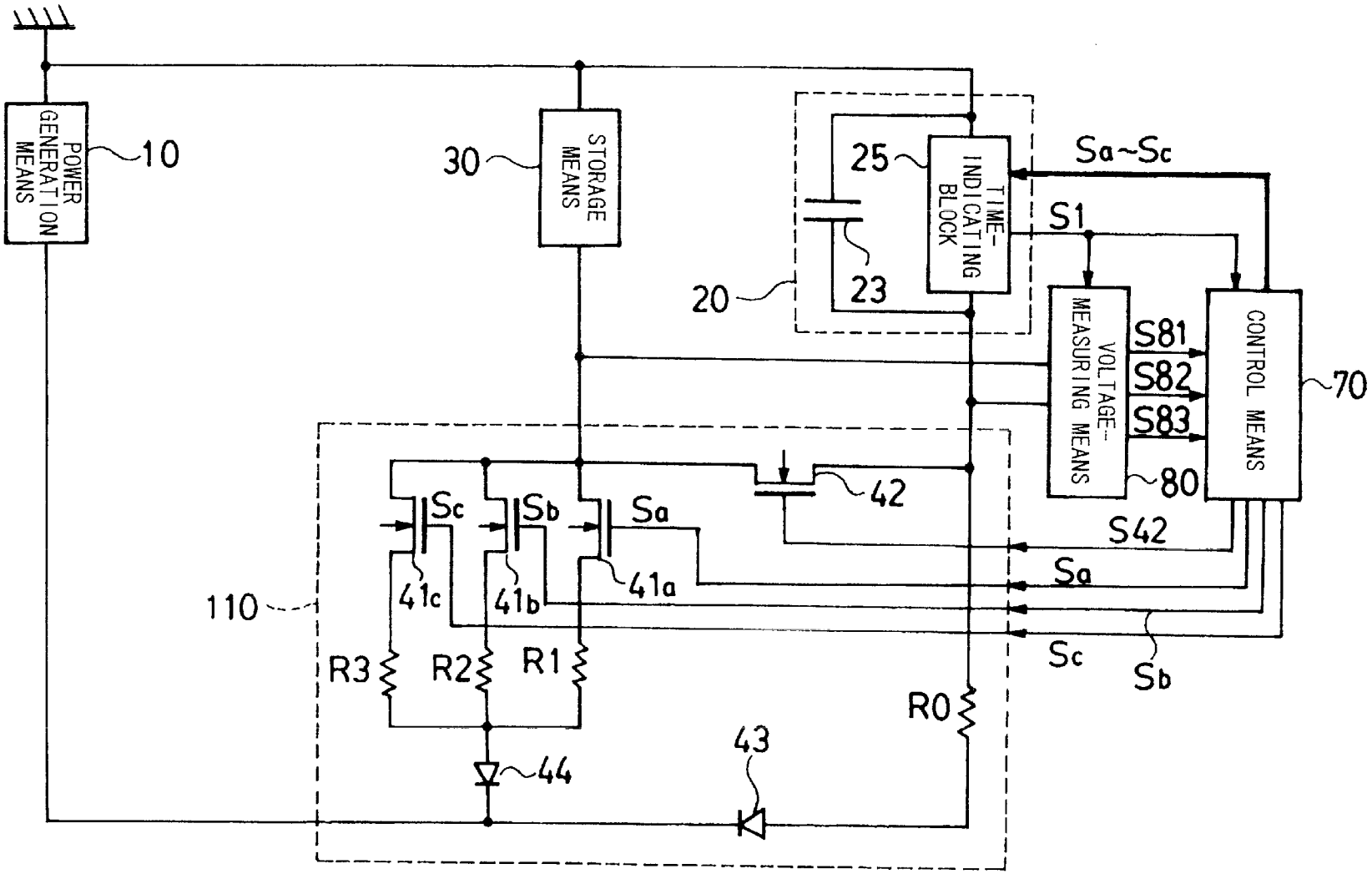
FIG. 5 is a block circuit diagram showing the constitution of a third embodiment of an electronic timepiece according to the invention.
Figure 6:
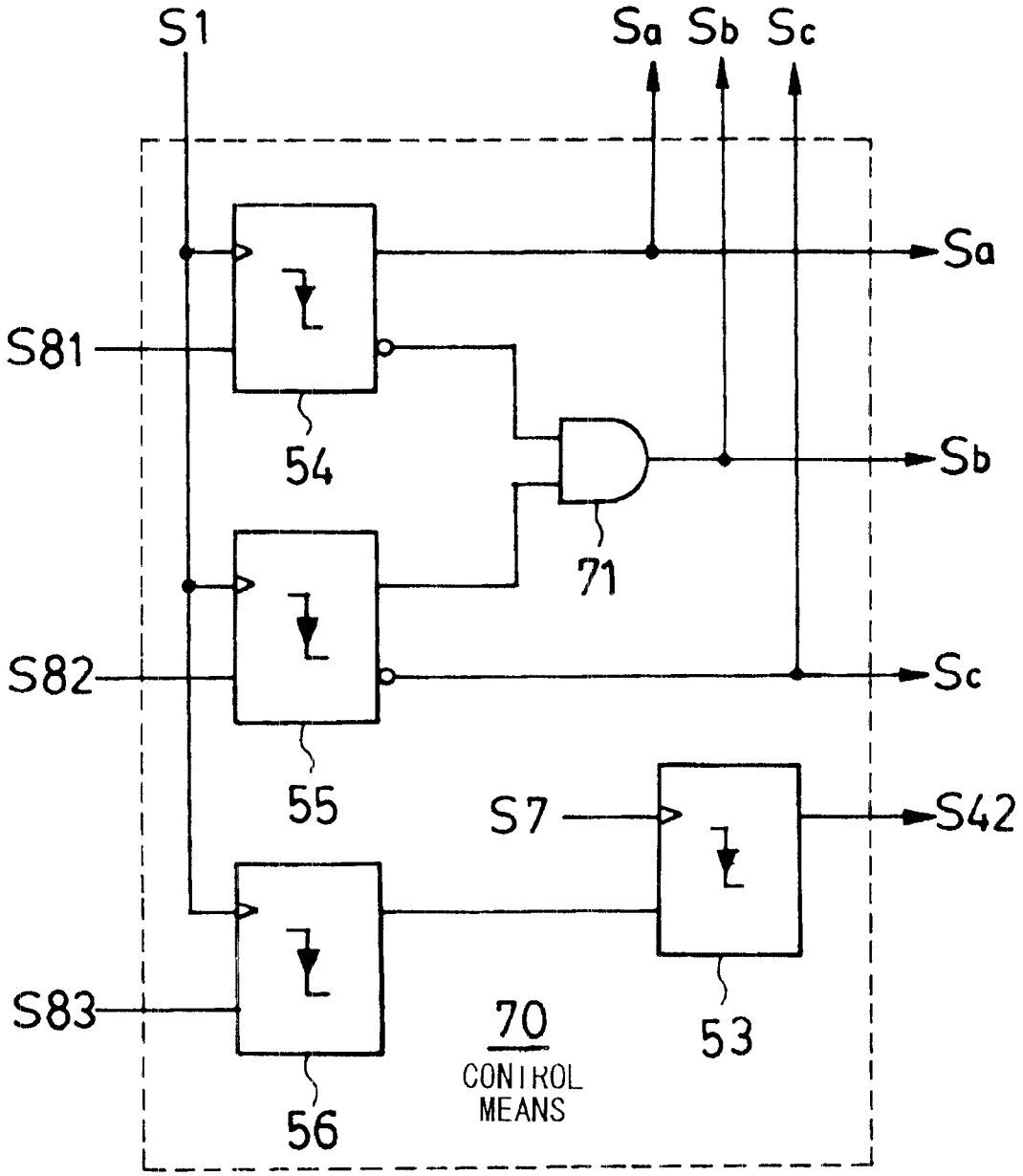
FIG. 6 is a circuit diagram showing a specific example of control means of the electronic timepiece shown in FIG. 5.

FIGS. 5 and 6

Next, a third embodiment of an electronic timepiece according to the invention is described with reference to FIGS. 5 and 6. In these figures, parts corresponding to those in FIGS. 1 and 2 are denoted by like reference numerals, and description thereof is omitted.

The electronic timepiece according to the third embodiment differs from the same according to the first embodiment shown in FIG. 1 only in that control means 70 and a switching circuit 110 differ from the control means 50 and the switching circuit 40 as described previously, respectively.

In the switching circuit 110, a series circuit comprised of a switching device Sa and a resistor R1, a series circuit comprised of a switching device Sb and a resistor R2, and a series circuit comprised of a switching device Sc and a resistor R3 are connected in parallel in place of the first switching device 41 for interconnection between the anode of a second diode 44, and the negative terminal of storage means 30. Further, a resistor R0 is interposed between a first diode 43 and time-indicating means 20.

As shown in FIG. 6, the control means 70 is comprised of the same four latches as the first to fourth latches 54, 55, 56, 53 of the control means 50 according to the first embodiment, and an AND gate 71 for outputting an AND of the inverse of an output of the first latch 54 and an output of the second latch 55.

Then, the control means 70 sends out the output of the first latch 54 as a switch control signal Sa, an output of the AND gate 71 as a switch control signal Sb, and the inverse of the output of the second latch 55 as a switch control signal Sc to the switching circuit 110 in FIG. 5, thereby turning selectively any one of the switching device 41*a*, the switching device 41*b*, and the switching device 41*c* ON.

Thus, it follows that the resistor R0 remains interposed all the time in a charging circuit from power generation means 10 to the time-indicating means 20 while any of the resistors R1, R2, and R3 is selectively interposed in a charging circuit from the power generation means 10 to the storage means 30.

Accordingly, the electronic timepiece according to the third embodiment is constituted such that the control means 70 determines a ratio of impedance of a charge current supply circuit from the power generation means 10 to the storage means 30 to the same from the power generation means 10 to the time-indicating means 20 at any of a plurality of predetermined different ratios (determined depending on a ratio of a resistance value of the resistor R0 to a resistance value of the respective resistors R1, R2, R3) according to results of measurement by voltage-measuring means 80, thereby differentiating a ratio of electric energy distributed between the storage means 30 and the time-indicating means 20 by controlling the switching circuit 110.

Still, the same operation and effect as those for the electronic timepiece according to the first embodiment can be obtained.

By way of example, the resistance value of the resistors R0, R1, R2, and R3 are as follows:

$R0$=100 Ω, R1=100 Ω, R2=150 Ω, and R3=175 Ω

By inputting the switch control signals Sa, Sb and Sc from the control means 70 to a time-indicating block 25, an amount of electric energy consumed by the time-indicating means 20 for executing time display is controlled by electric energy amount control means installed in the time-indicating block 25 so as to be within a predetermined range all the time on the basis of the results of measurement by the voltage measuring means 80 as with the case of the first embodiment.

Further, the electronic timepiece according to the second embodiment as shown in FIG. 4 can also be modified so as to have the same control means as the control means 70 according to the third embodiment and the same switching circuit as the switching circuit 110 according to the third embodiment.

INDUSTRIAL UTILIZATION

As is evident from the foregoing description, the electronic timepiece according to the invention is constituted such that a voltage between the terminals of the time-indicating means is measured, and a ratio of electric energy to be distributed when delivering the electric energy generated by the power generation means to the side of the time-indicating means, and to the side of the storage means can be optimally set according to the results of the measurement.

This enables the electric energy generated to be adequately distributed between the time-indicating means and the storage means, and efficiency of charging the storage means with the electric energy generated to be rendered better than before even if a cycle of the measurement is the same as before.

Further, even if an abrupt change occurs to the electric energy generated due to a change in the external environment, it is possible to prevent an abrupt change from occurring to a voltage between the terminals of the time-indicating means, so that time-indicating operation of the time-indicating means can be stabilized.

Thus, the performance of the electronic timepiece provided with the power generation means incorporated therein can be greatly enhanced.

What is claimed is:

1. An electronic timepiece comprising:

power generation means for generating electricity from external energy;

storage means for storing the electric energy generated by said power generation means;

time-indicating means for executing time display operation by use of the electric energy supplied from said power generation means or said storage means;

a switching circuit comprising at least a plurality of switching devices, for executing transfer or interruption of the electric energy among said power generation means, said storage means, and said time-indicating means;

voltage-measuring means for measuring a terminal voltage of said time-indicating means, being capable of deciding in which range the voltage is included among at least three levels of voltage ranges; and control means for controlling said switching circuit by determining a ratio of electric energy to be distributed between said storage means and said time-indicating means in a set period during charging of said storage means and said time-indicating means by said power generation means at any of at least three different ratios predetermined so that said ratios correspond to said at least three levels of voltage ranges one-to-one, according to a voltage range decided by said voltage-measuring means.

2. An electronic timepiece according to claim 1, wherein said control means is means for controlling said switching circuit by determining a ratio of supply time of charge current from said power generation means to said storage means to supply time of charge current from said power generation means to said time-indicating means in a set period during charging of said storage means and said time-indicating means by said power generation means at any of the at least three different ratios predetermined so that said ratios correspond to said at least three levels of voltage ranges one-to-one, according to the voltage range decided by said voltage-measuring means.

3. An electronic timepiece according to claim 1, wherein said control means is means for controlling said switching circuit by determining a ratio of impedance of a charge current supply circuit from said power generation means to said storage means to impedance of a charge current supply circuit from said power generation means to said time-indicating means during charging of said,storage means and said time-indicating means by said power generation means at any of the at least three different ratios predetermined according to the at least three levels of voltage range decided by said voltage-measuring means.

4. An electronic timepiece according to claim 1, wherein said time-indicating means is provided with an electric energy amount control means for controlling an amount of electric energy consumed by said time-indicating means for executing a time display so as to be within a predetermined range all the time according to the results of measurement by said voltage-measuring means.

5. An electronic timepiece according to claim 4, wherein said time-indicating means comprises a stepping motor, and said electric energy amount control means is means for controlling an amount of electric energy consumed for executing said time display so as to be within a predetermined range all the time by setting a pulse at which electric current is supplied to said stepping motor to any of a plurality of predetermined different shapes, as selected according to the results of measurement by said voltage-measuring means.

6. An electronic timepiece according to claim 1, wherein said time-indicating means comprises an auxiliary storage means for temporarily storing the electric energy.

7. An electronic timepiece comprising:

power generation means for generating electricity from external energy;

voltage-up means for boosting a voltage generated by said power generation means;

storage means for storing electric energy boosted by said voltage-up means;

time-indicating means for executing time display operation by use of the electric energy supplied from said voltage-up means or said storage means;

a switching circuit comprising at least a plurality of switching devices for executing transfer or interruption of the electric energy among said voltage-up means, said storage means, and said time-indicating means;

voltage-measuring means for measuring a terminal voltage of said time-indicating means, being capable of deciding in which range the voltage is included among at least three levels of voltage ranges; and control means for controlling said switching circuit by determining a ratio of electric energy to be distributed between said storage means and said time-indicating means in a set period during charging of said storage means and said time-indicating means by said power generation means via said voltage-up means at any of at least three different ratios predetermined so that said ratios correspond to said at least three levels of voltage ranges one-to-one, according to a voltage range decided by said voltage-measuring means.

8. An electronic timepiece according to claim 7, wherein said control means is means for controlling said switching circuit by determining a ratio of supply time of charge current from said voltage-up means to said storage means to supply time of charge current from said voltage-up means to said time-indicating means in a set period during charging of said storage means and said time-indicating means by said power generation means via said voltage-up means at any of the at least three different ratios predetermined so that said ratios correspond to said at least three levels of voltage ranges one-to-one, according to the voltage range decided by said voltage-measuring means.

9. An electronic timepiece according to claim 7, wherein said control means is means for controlling said switching circuit by determining a ratio of impedance of a charge current supply circuit from said voltage-up means to said storage means to impedance of a charge current supply circuit from said voltage-up means to said time-indicating means during charging of said storage means and said time-indicating means by said power generation means at any of the at least three different ratios predetermined according to the at least three levels of voltage range decided by said voltage-measuring means.

10. An electronic timepiece according to claim 7, wherein said time-indicating means is provided with an electric energy amount control means for controlling an amount of electric energy consumed by said time-indicating means for executing a time display so as to be within a predetermined range all the time according to the results of measurement by said voltage-measuring means.

11. An electronic timepiece according to claim 10, wherein said time-indicating means comprises a stepping motor, and said electric energy amount control means is means for controlling an amount of electric energy consumed for executing said time display so as to be within a predetermined range all the time by setting a pulse at which electric current is supplied to said stepping motor to any of a plurality of predetermined different shapes, as selected according to the results of measurement by said voltage-measuring means.

12. An electronic timepiece according to claim 7, wherein said time-indicating means comprises an auxiliary storage means for temporarily storing the electric energy.

* * * * *